US007654838B1

(12) United States Patent
Zhuge

(10) Patent No.: US 7,654,838 B1
(45) Date of Patent: Feb. 2, 2010

(54) UNIVERSAL-CONVERSION POWER CABLE

(76) Inventor: Rui Zhuge, 4B, Block 2, Tai Hua Commercial Town, Ten District, Baoan, Shenzhen, Guangdong Province (CN)

( * ) Notice: Subject to any disclaimer, the term of this patent is extended or adjusted under 35 U.S.C. 154(b) by 0 days.

(21) Appl. No.: 12/329,641

(22) Filed: Dec. 8, 2008

(51) Int. Cl.
*H01R 29/00* (2006.01)

(52) U.S. Cl. ..... 439/173

(58) Field of Classification Search ..... 439/166–183, 439/131

See application file for complete search history.

(56) References Cited

U.S. PATENT DOCUMENTS

| | | | | |
|---|---|---|---|---|
| 6,261,109 | B1 * | 7/2001 | Liu et al. | 439/174 |
| 6,592,406 | B2 * | 7/2003 | Liu | 439/172 |
| 6,659,782 | B2 * | 12/2003 | Wu | 439/131 |
| 6,988,903 | B1 * | 1/2006 | Cheng | 439/137 |
| 7,008,246 | B2 * | 3/2006 | Zhuge | 439/173 |
| 7,223,126 | B2 * | 5/2007 | Ng | 439/357 |

* cited by examiner

*Primary Examiner*—Briggitte R Hammond

(57) ABSTRACT

The present invention publishes a universal conversion power cable, comprising a plug subassembly built by the clamping of a plug socket equipped with conductive components on the inside and a replaceable plug, wherein a power cord connected correspondingly to the conductive components, a plug-in slot which is closed on one end and open on the other end is configured on the surface of the plug socket. The replaceable plug is plugged into that plug-in slot, while the front side of the replaceable plug is just adjacent to the closed-end wall surface of the plug-in slot, the power cord is connected to the open-end of the plug-in slot on the plug socket. The present invention connects the power cord to the open-end of the plug-in slot on the plug socket. When this power connecting device is inserted into the power socket, careless dragging of the power cord or removing the device along the downward direction of the power cord with improper force makes the plug socket and the replaceable plug resist to each other even more tightly, making it impossible to pull off the plug socket separately, effectively solving the defect of the existing technology, significantly improving the safety performance and completely meeting the safety standard of the electric appliance in western countries.

7 Claims, 4 Drawing Sheets

UNIVERSAL-CONVERSION POWER CABLE

BACKGROUND OF THE INVENTION

This invention relates to a power connecting device, and more especially, to a power cable that can be conveniently and safely plugged into the power sockets of different specifications and standards.

With the continuous development of science and technology, people cannot live or work without electricity. For the convenience of using electricity, people have created many kinds of power sockets applicable to industrial production or civil use and their correspondent plugs, thereby increasing production efficiency and living quality. However, since the power sockets and plugs produced in different regions or countries around the world differ by their specifications and standards, manufacturers have to produce products according to different specifications and standards. The manufacturing of the products of different standards will restrict the quantity of each batch, which will make it more difficult to further reduce the product prices. If users are using the electrical appliance products made in different regions, embarrassing situations where the sockets and plugs do not match occur, and the device cannot be used. In order to improve the situation, various kinds of power connecting devices enabling plug replacement have been designed within the industry. However, in terms of the existing power connecting devices, they are all designed to connect the power cord to the end that is opposite to the separation of the replaceable plug and the socket. When the power connecting device is inserted into the power socket, careless dragging of the power cord or taking off the power connecting device along the direction of the power cord, in the direction where the power socket and the replaceable plug are separated, will easily pull off the socket, with the replaceable plug still remained on the power socket and the root of the pins exposed, thus to lead to hidden risks of safety and great inconvenience for people who work abroad or travel a lot. Developing a power connecting device with convenient and reliable inserting and pulling as well as safe use is an urgent problem in this field.

BRIEF SUMMARY OF THE INVENTION

The present invention aims at providing a universal conversion power cable with the features of simple structure, easy and flexible plug separation, firm connecting and safe use, to solve the technical problem that the connecting of existing power connecting devices is not firm and easy to fall off, as well as imperfect security.

To address the aforesaid technical problems, the technical solution of the present invention is to construct a universal conversion power cable, including the plug assembly formed by the clamping of the plug socket which is equipped with conductive components on the inside combined with the replaceable plug and the power cords connected to the correspondent conductive components. A plug-in slot, which is closed on one end and open on the other end, is configured on the surface of the plug socket. The replaceable plug is inserted into the plug-in slot. The front side of the replaceable plug is adjacent to the wall surface of the closed-end of the plug-in slot. The power cord is connected to the open-end of the plug-in slot on the plug socket.

Among these, the guide slots used for the inserting and pulling of the replaceable plugs are configured separately on the two symmetrical sides of the plug-in slot; the conductive components inside the plug socket interpenetrate through the bottom surface of the plug-in slot and form the flexible electrode contacts. The replaceable plug includes the base, the convex-edge configured at the lower part of the 2 sides of the base that can slip combining with the guide slot, the pins of different specifications and standards vertically interpenetrating the base and correspondingly resisting the voltage of the electrode contacts.

The pins can be any one among the Chinese, American, British, Australian or European and other standards.

Among the optimum schemes of this invention, a strip-shaped spring plate is configured at the closed end of the bottom surface of the plug-in slot, the spring plate extends to one side and to the outside surface of the plug socket and forms a button. The 2 sides of the spring plate and the casing material of the button end and the plug socket are cut to be broken, the other end of the spring plate shall always be connected to the casing materials of the bottom surface of the plug-in slot. A protruding strip is configured on the spring plate near the closed-end wall surface of the plug-in slot, the strip can be clamped to the front side of the replaceable plug, so as to form the clamping of the plug socket and the replaceable plug.

The electrode contacts are distributed triangularly. The interior surface of the replaceable plug is configured with a trench for the electrode contact of the grounding wire to pass through. The width of the trench is less than the length of the protruding strip on the spring plate. There are notches on the edges of the guide slots on the 2 sides of the plug-in slot. The convex edges of the replaceable plug are configured discontinuously both front and rear. The convex edge of the front section may be adapted to the notches.

A safety fuse, which is connected to the conductive component inside the plug socket, is configured at the bottom surface on the side of the opened-end of the plug-in slot. That safety fuse is located in the groove under the movable cover.

A bulge convenient for grabbing with the hand is configured on the surface opposite to the plug-in slot on the plug socket.

In the present invention, the plug sockets equipped with conductive components and the replaceable plugs are manufactured separately.

The universal plug sockets can be put in to mass production, while the replaceable plugs can be manufactured according to different specifications and standards, thus the production cost can be reduced significantly. Meanwhile, users can choose the suitable replaceable plugs to match with the plug socket according to the situation of different countries and regions, thereby providing great convenience for users. The installation and disassembly can be performed smoothly and steadily with suitable clamping of the notches in the center of the edges of the guide slots on the 2 sides of the plug-in slot and the discontinuous protruding strips on the base. The fixing or disassembly of the replaceable plugs can be performed conveniently with the clamping of the protruding strip on the spring plate of the plug socket and the front side of the base.

More importantly, based on many years of experience and lessons, after hundreds of experiments, this inventor decides to connect the power cord to the opening end of the plug-in slot of the plug socket. This structural improvement seemed not as complex after consideration, but it did effectively solve the problem of the safety of the replaceable power connecting device that has puzzled the industry for a long time, and achieved unexpected technical effect. In the present invention, the power cord is connected to the end that separates the replaceable plug and the plug socket, so when the power connecting device is inserted into the power socket, careless dragging of the power cord or removing a device along the direction of the power cord with improper force will just make the front side of the replaceable plug withstand the closed-end wall surface of the plug-in slot firmly, i.e. make the plug socket and the replaceable plug sustain each other even more tightly, making it impossible to pull off the plug socket separately, effectively solving the defect of the current easy-to-fall technology, significantly improving the safety performance and completely meeting the safety standard of electric appliances in western countries.

BRIEF DESCRIPTION OF THE DRAWINGS

The present invention is further detailed in combination with the drawings attached and embodiments hereinafter, including.

DETAILED DESCRIPTION OF THE INVENTION

Figure 1:
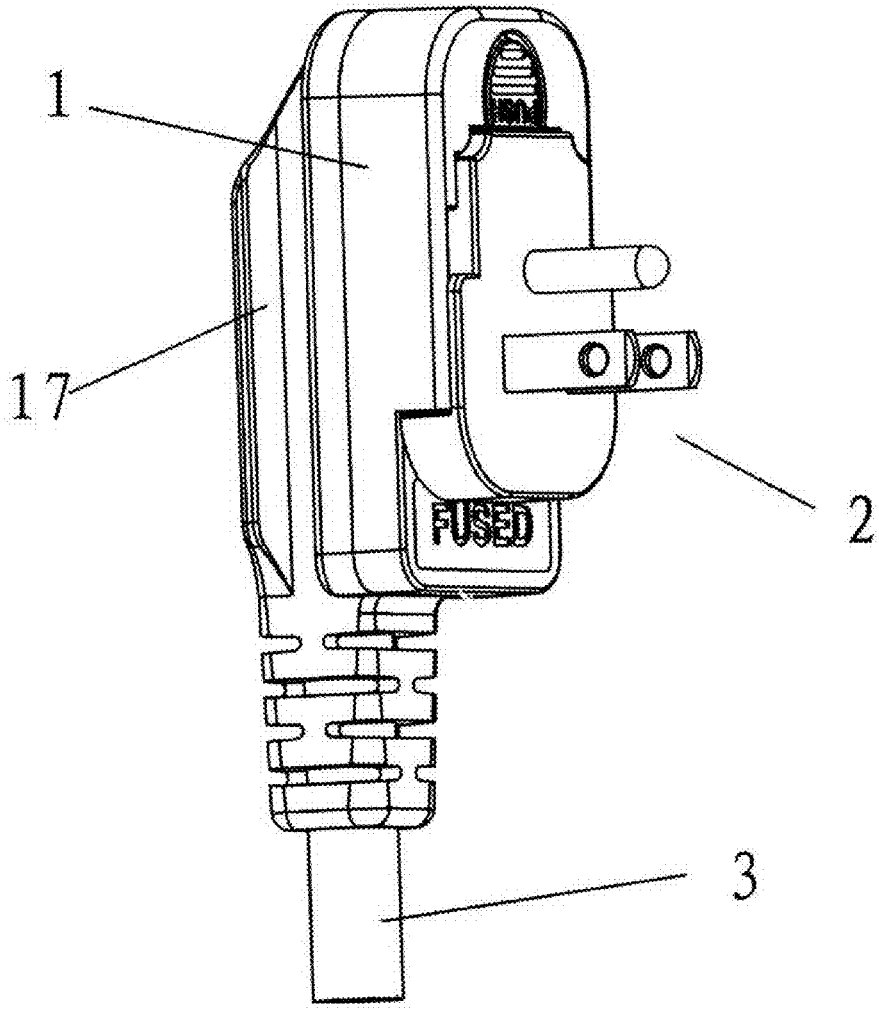
FIG. 1 is the stereoscopic view of the present invention.
Figure 2:
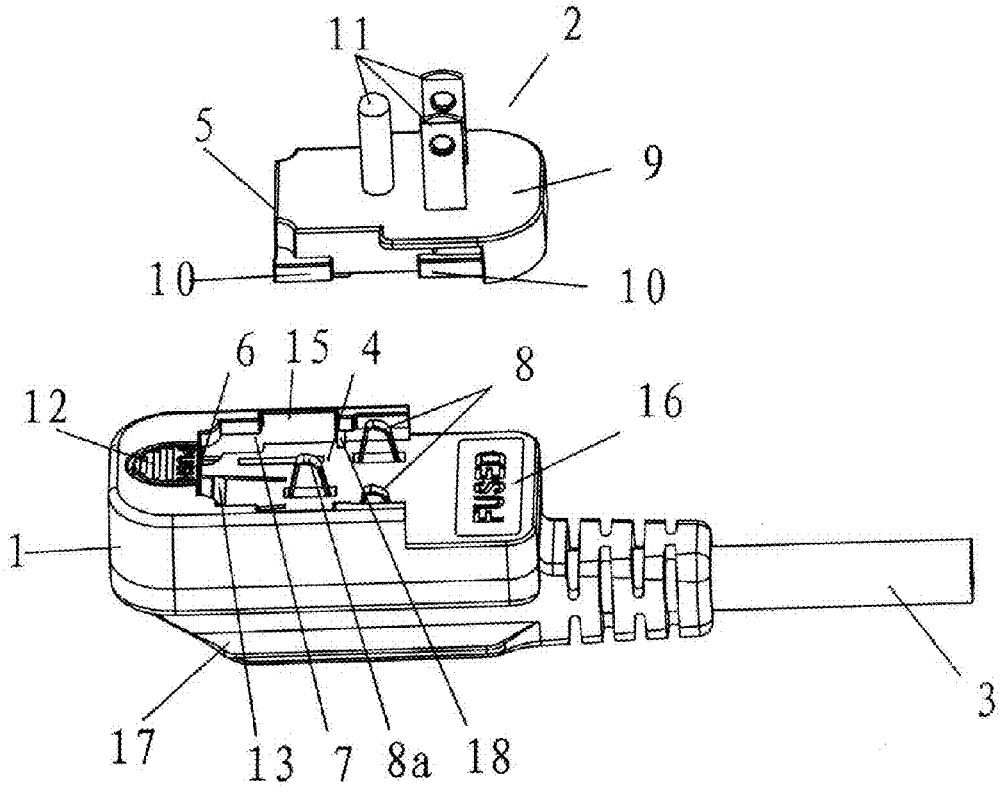
FIG. 2 is the decomposition schematic view of FIG. 1.

FIG. 1 indicates the external structure of the assembly system in the optimal embodiment for the present invention. FIG. 2 indicates the decomposition of the stereoscopic structure of the optimal embodiment for the present invention.

Figure 3:
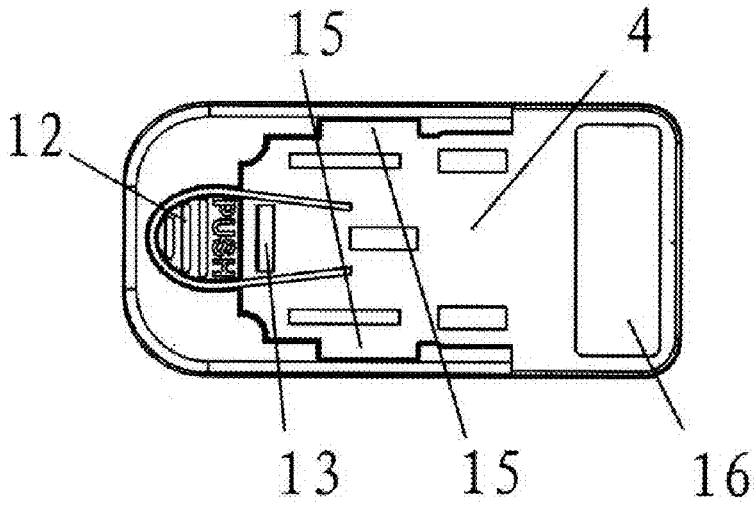
FIG. 3 is the front view of the casing body of the plug socket in the optimal embodiment for the present invention.
Figure 4:
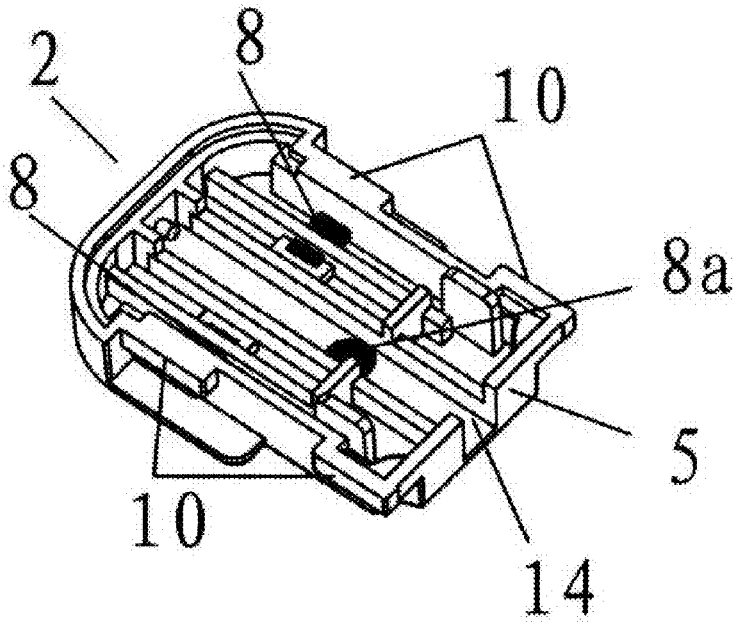
FIG. 4 is the stereoscopic schematic view of the interior surface of the base of the replaceable plug in the optimal embodiment for the present invention.

The universal power cable includes a plug sub-assembly, which is built by the clamping of a plug socket 1 equipped with conductive components inside and a replaceable plug 2. It also includes a power cord 3, one end of which is connected to the conductive component in plug socket 1, the other end of which is connected to a plugging device (omitted in the figure) used for the connection to other electric devices. The upper surface of the plug socket 1 is configured with a plug-in socket 4 that is closed at the left and open at the right, the replaceable plug 2 shall be inserted in to the plug-in socket 4. The front side 5 (left side) of the replaceable plug 2 is adjacent to the closed-end wall surface 6 of the plug-in slot 4, while the power cord 3 is connected to the opening end of the plug-in slot on the plug socket. In this embodiment, the symmetrical horizontal 2 sides of the plug-in slot 4 are both separately configured with a guide slot 7 used for the replaceable plug 2 to be inserted in and pulled out. There is a notch 15 in the center of the edge of the guide slot, and a blocking bulge 18 configured in the guide slot on the right of the notch. The conductive component inside the plug socket 1 penetrates to the bottom surface of the plug-in slot 4, and forms a flexible electrode contact 8, 8*a* distributed triangularly (See FIG. 3). There is a strip spring plate configured at the closed end of the bottom surface of the plug-in slot 4, the spring plate that extends to the left and to the outer surface of the plug socket 1 and form a button 12. There are kerfs cut open on the upper and lower sides of the spring plate, the left side of the button and the casing materials of the plug socket have kerfs, thereby they are disconnected. The right end of the spring plate is always connected to the casing materials of the bottom surface of the plug-in socket 4. There is a convex strip 13 configured on the spring plate near the closed-end wall surface of the plug-in socket 4, and that convex strip may be clamped with the front edge 5 of the replaceable plug 2, so as to form the clamping of the plug socket 1 and the replaceable plug 2. There is a safety fuse connected to the conductive component inside the plug socket 1, configured on the bottom surface of the side of the open-end on the plug-in socket 4, and that fuse is located in the groove inside the movable cover 16. There is also a bulge 17 for the convenience of grabbing on the back of the plug socket 1. The replaceable plug 2 includes; A base 9 with bending sides, a convex edge 10 which is configured at the lower part of the 2 sides of the base and is able to slip with the guide slot 7. That convex edge 10 is configured as discontinuous front and back, the convex edge of the front section can be adapted to the notch 15 of the guide slot. A trench 14, which is used for the grounding wire electrode contact 8*a* to go through, is configured on the inner surface of the replaceable plug 2; the width of the trench is less than the length of the protruding strip on the spring plate (See FIG. 4). The pins 11 of different specifications and standards correspondingly resisting the voltage of the electrode contacts 8, 8*a* are vertically interpenetrating the base 9. These pins may be of any kind among the Chinese, American, British, Australian or European or other standards.

Figure 5:
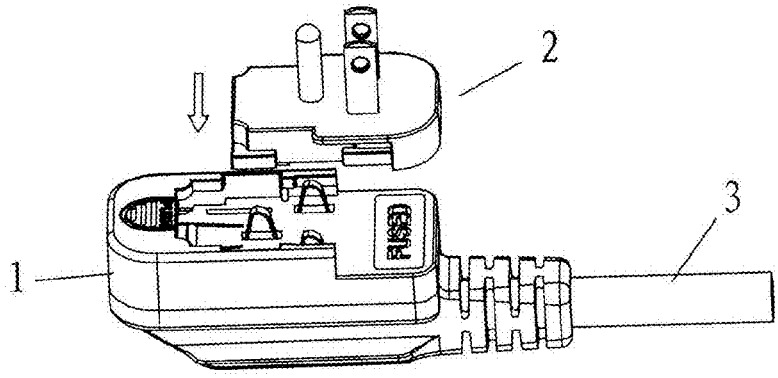
FIG. 5, FIG. 6 and FIG. 7 are the assembly and disassembly schematic view of the replaceable plug in the optimal embodiment for the present invention.
Figure 6:
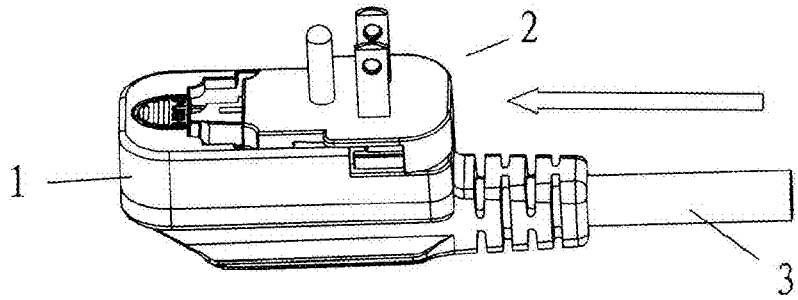

As shown in FIG. 5, when inserting the replaceable plug 2 into the plug socket 1, one only needs to align the convex edge 10 of its front end down to the notch 15 of the guide slot 7 on the plug socket and insert, and push the plug in to the guide slot 7 (as shown in FIG. 6). At this time, the trench 14 of the inner surface of the plug 2 shall flip over the grounding wire electrode contact 8*a* on the plug-in slot 4, the front side 5 of the replaceable plug 2 shall touch the protruding strip 13 on the spring plate of the plug-in slot first and force it downward;

when the replaceable plug 2 is pushed to the left and into the right place, the protruding strip 13 will return to its place by the effect of the elastic force of the spring plate, and will be clamped into the inner surface of the front side 5 of the plug 2, thus the replaceable plug 2 and plug socket 1 will be connected and fixed. When the replaceable plug 2 is connected to the plug socket 1, the electrode contacts 8 and 8*a* shall correspondingly contact with the various pins 11 on the replaceable plug 2, in order to conduct electric current and lead out electric current through the power cord 3.

Figure 7:
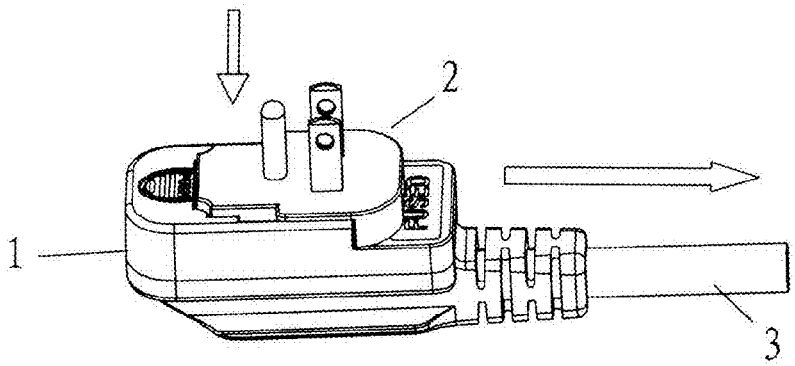

As shown in FIG. 7, when it is necessary to replace the replaceable plug 2 with another one of different specification and standard, by pressing the button 12, the protruding strip 13 can be taken down and detached from the front side 5 of the replaceable plug 2. Now it can be pushed out to the right, and when it slips to the notch 15, it shall be stopped by the blocking bulge 18 on the right end of the guide slot (See FIG. 2), and can only be pushed upward to be dismounted. The blocking bulge can prevent the replaceable plug 2 from slipping out to the right and avoid the front side of the plug 2 from causing damage to the electrode contact 8 of the live wire and the zero line.

Certainly, the convex edge of the replaceable plug 2 could also be made into continuous shape, and no notch 15 shall be made on the guide slot 7. During installation, the replaceable plug 2 shall be pushed from the opening end of the plug-in slot on the plug socket into the guide slot 7. For implementing this structure, there should be trenches on the inner surface of the replaceable plug 2 for the electrode contact 8 and 8*a* on the plug-in slot 4 to go through.

See FIG. 1, the present invention connects the power cord to the opening end of the plug-in slot on the plug socket. When this power connecting device is inserted into the power socket, careless dragging of the power cord or taking off of the device along the downward direction of the power cord with improper force will just make the front side of the replaceable plug withstand the closed-end wall surface of the plug-in slot more firmly, i.e. it will make the plug socket and the replaceable plug sustain each other even more tightly, making it impossible to pull off the plug socket separately, effectively solving the defect of the existing technology, significantly improving the safety performance and completely meeting the safety standards for electric appliances in western countries.

I claim:

1. A universal conversion power cable, comprising a plug subassembly built by clamping together a plug socket (1) equipped with conductive components inside and a replaceable plug (2), and a power cord (3) connected correspondingly to the conductive components, characterized in that a plug-in slot (4) which is closed on one end and open on the other end is configured on a surface of the plug socket (1), the replaceable plug (2) is plugged into the plug-in slot (4), while a front side (5) of the replaceable plug (2) is just adjacent to a wall surface (6) of the closed-end of the plug-in slot (4), the power cord (3) is connected to the open-end of the plug-in slot (4) on the plug socket; a safety fuse, which is connected to the conductive component inside the plug socket (1), is configured at a bottom surface on a side of the open-end of the plug-in slot (4), the safety fuse is located in a groove under a movable cover (16).

2. The universal conversion power cable according to claim 1, characterized in that a bulge (17) convenient for grabbing with hand is configured on a surface opposite to the plug-in slot (4) on the plug socket (1).

3. The universal conversion power cable according to claim 1, characterized in that guide slots (7) for the replaceable plugs (2) to be inserted in and pulled out are separately configured on both symmetrical sides of the plug-in slot (4), the conductive components inside the plug socket (1) interpenetrate the bottom surface of the plug-in slot (4) and form flexible electrode contacts (8); the replaceable plug (2) comprising: a base (9), convex sides (10) that can slip with the guide slots (7) configured on both sides of the base, pins (11) which can correspondingly resist voltage of the electrode contacts (8), interpenetrating vertically on the base (9).

4. The universal conversion power cable according to claim 3, characterized in that there is a strip-shaped spring plate configured at the closed end of the bottom surface of the plug-in socket (4), the spring plate extends toward one side and to an outer surface of the plug socket (1) and form a button (12), both sides of the spring plate and casing material of an end of the button and the plug socket are cut to be broken, the other end of the spring plate shall be always connected to the casing material of the bottom surface of the plug-in slot (4), a protruding strip (13) is configured on the spring plate near the wall surface (6) of the closed-end of the plug-in slot (4), the strip can be clamped to the front side (6) of the replaceable plug (2), so as to form the clamping of the plug socket (1) and the replaceable plug (2).

5. The universal conversion power cable according to claim 4, characterized in that the electrode contacts (8) are distributed triangularly, a trench (14), which is used for the grounding wire electrode contact (8*a*) to go through, is configured on an inner surface of the replaceable plug (2), the trench has a width which is less than length of the protruding strip (13) on the spring plate.

6. The universal conversion power cable according to claim 5, characterized in that there are notches (15) on edges of the guide slots (7) on both the symmetrical sides of the plug-in slot (4), the convex sides (10) of the replaceable plug are configured discontinuously front and rear, the convex sides can be adapted to the notches (15) at their fronts.

7. The universal conversion power cable according to claim 6, characterized in that the pins (11) on the base (2) may be of any kind among Chinese, American, British, Australian or European or other standards.

* * * * *